United States Patent [19]

Brown

[11] 4,030,474

[45] June 21, 1977

[54] AIR TREATING DISPENSER

[76] Inventor: Harold Ben Brown, 2951 Village Drive, Marietta, Ga. 30062

[22] Filed: Oct. 8, 1975

[21] Appl. No.: 620,549

[52] U.S. Cl. ..... 126/113

[51] Int. Cl.[2] ..... F24F 3/14

[58] Field of Search ..... 126/113; 21/55; 261/119 R

[56] References Cited

UNITED STATES PATENTS

| | | | |
|---|---|---|---|
| 2,059,408 | 11/1936 | Stark | 126/113 X |
| 2,338,144 | 1/1944 | Turnbull | 126/113 |
| 2,786,714 | 3/1957 | Saleny | 126/113 |
| 3,479,297 | 11/1969 | Rutzen et al. | 21/55 X |

*Primary Examiner*—William R. Cline
*Attorney, Agent, or Firm*—Hill, Gross, Simpson, Van Santen, Steadman, Chiara & Simpson

[57] ABSTRACT

An air treatment system for buildings having forced air heating and or cooling systems including an evaporation pan and reservoir member received in ducting of the system downstream of the temperature changing portions of the system, the reservoir being located exterior of the ducting, the evaporation tray being received interior of the ducting, the sizing of the evaporation tray and the parameters of the added liquid to be evaporated being chosen to provide a given evaporation range to produce an odor control system.

2 Claims, 4 Drawing Figures

AIR TREATING DISPENSER

BACKGROUND OF THE INVENTION

1. Field of the Invention

This invention relates to air treating systems and more particularly to an odor control system for use in association with forced air heating and or air conditioning systems.

2. Prior Art

Odor control in residential and commercial structures is often times highly desirable. In the past, such control has normally been accomplished on a localized basis either through the use of room located evaporating odorant-deodorant liquids, solids or the like, or through the use of user activated temporary devices such as for example hand activated aerosol units.

It has also been suggested in the past, to provide more permanent systems which, in some instances, may be built into apparatus located within the individual rooms, or in other instances may be designed to provide air quality control for a plurality of rooms.

It has been determined that odor control can be best achieved through the use of a combination of odorants and deodorants having specific characteristics which tend to neutralize existent odors while masking odors which cannot be neutralized. It is a desired objective to utilize that system which, in itself, is not substantially noticable by the average person.

The prior art has not provided a total system which is versatile economical both to construct, install, and operate and effective to control a wide range of odors.

SUMMARY OF THE INVENTION

My invention provides a system for dispensing odorant controlled materials throughout the entirety of a residential or commercial building or throughout a selected portion of such a building. The invention makes use of pre-existent forced air heating and/or cooling systems and introduces an odor control formulation into the forced air system at an opportune point.

Preferably, I utilize an evaporation tray which extends into ducting of the forced air system and which is open to the air flow through the system on at least one side. The evaporator tray, in the preferred embodiment, is associated with a reservoir to provide extended time periods between necessary replenishment. This device is used in association with an odor-deodorant formulation having characteristics which will provide a required evaporation rate.

It is therefore a general object of this invention to provide a system for controlling odors in commercial or residential structures.

It is another and more specific object of this invention to provide a system for controlling odors in residential or commercial structures by introducing an odor-deodorant formulation to the air stream of a forced air heating and/or cooling system.

It is another and most specific object of this invention to provide an odor treating system for use in association with forced air heating and/or cooling systems which includes an evaporation tray placed within the ducting of the system downstream of the air temperature treatment area of the system, the evaporation tray being supplied from a reservoir located exterior of the ducting, and a liquid odor-deodorant formulation introduced to the reservoir and evaporation tray.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
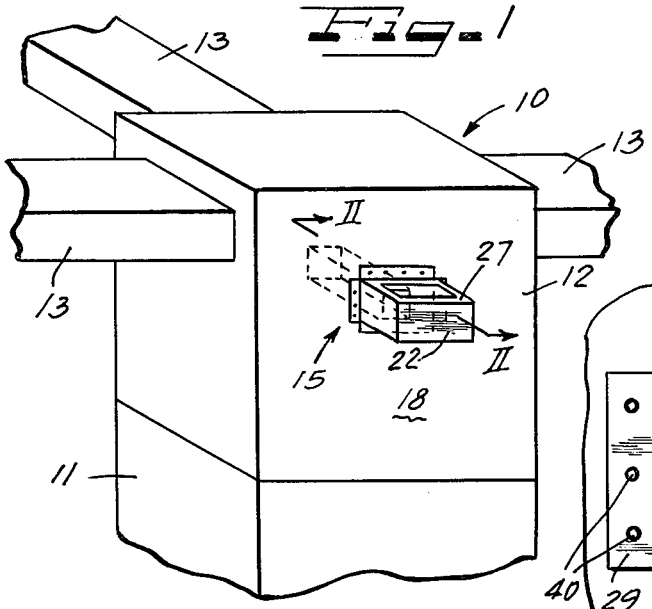
FIG. 1 is a perspective view of a heating and/or air conditioning forced air unit equipped with the evaporator of this invention.
Figure 4:
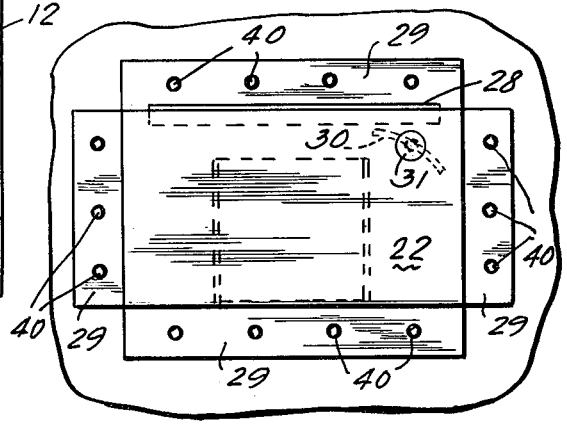
FIG. 4 is an exterior end plan view of the reservoir of this invention.

FIG. 1 illustrates generally a forced air heating and/or cooling system 10 which includes an air temperature treatment section 11 which may have received therein heating means or cooling means or both. Attached to this is a main plenum 12 having ducting 13 extending therefrom for distribution of the temperature controlled air to various sections of a residential or commercial building in which the unit 10 is received.

Figure 2:
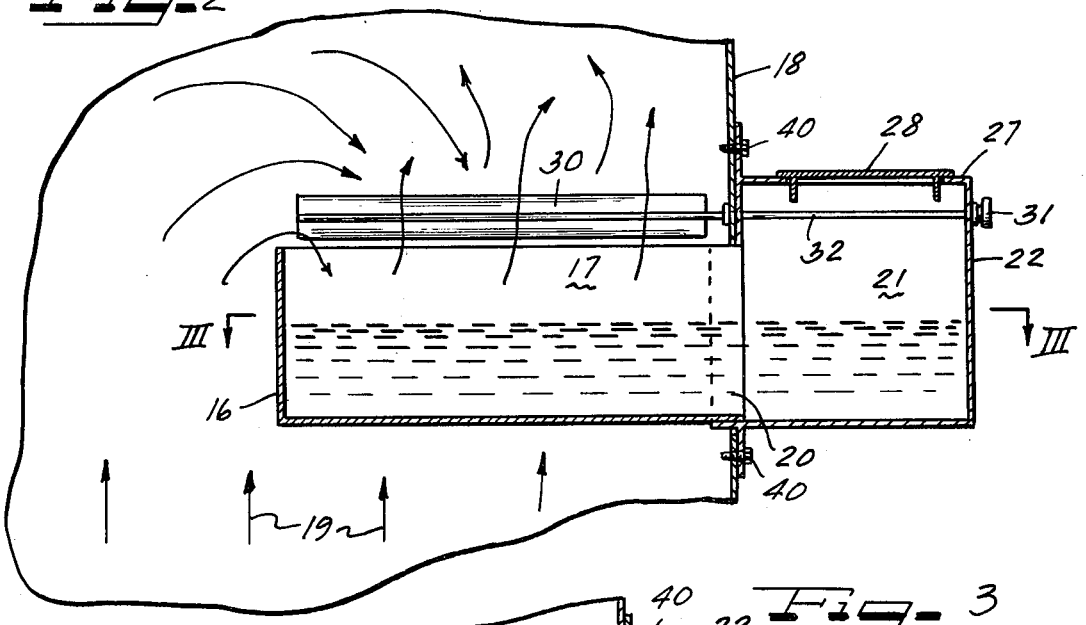
FIG. 2 is a fragmentary cross-sectional view taken along lines II—II of FIG. 1.
Figure 3:
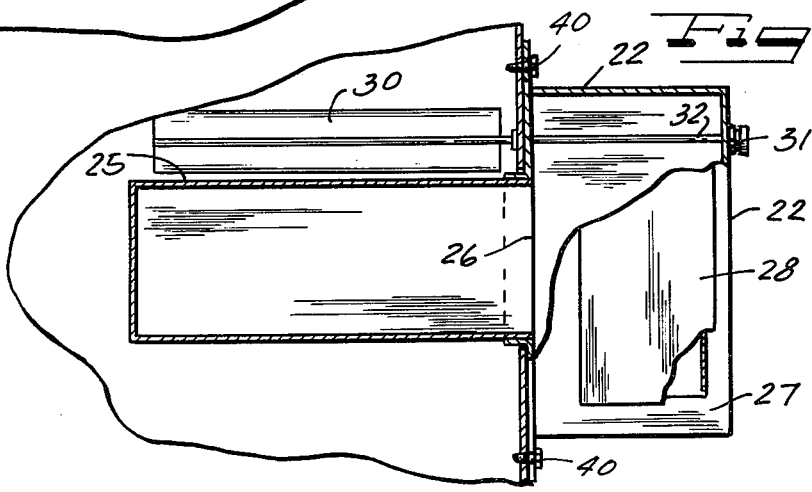
FIG. 3 is a fragmentary partially sectional view taken substantially along lines III—III of FIG. 2 but illustrating portions of the reservoir top.

According to this invention, the plenum 12 has an odor treatment unit 5 attached thereto. As best illustrated in FIG. 2 the odor treatment unit 15 includes an evaporation tray 16 having an open top 17 positioned interior of the wall 18 of the plenum within the flow of air as indicated by arrows 19. The evaporation tray has a portion 20 projecting through the wall 18 and open to the interior 21 of a reservoir 22 located exterior of the wall 18. It is to be understood that although in the embodiment illustrated the wall 18 comprises a wall of the main plenum 12, the wall could be a wall of one of the individual ducts 13. When the unit 15 is installed in the plenum, it will control odor throughout substantially the entirety of the structure or at least those portions of the structure which are temperature controlled by the unit 10. Where it is desired to provide specific odor control to certain locations within the structure, such as for example a commercial dining room within a restaurant, or a kitchen or the like, the unit 15 can be provided only in the ducting leading to such areas.

In the embodiment illustrated, the evaporation tray comprises an elongated rectangular member 25 having the open top 17 and an open end wall 26 which communicates with a substantially rectangular reservoir 22. The reservoir 22 is preferably considerably larger than the evaporation tray so as to provide sufficient fluid storage. In the embodiment illustrated, the combination of the evaporation tray and the reservoir is substantially T-shaped with the evaporator tray forming the main leg of the T and the reservoir forming the cross bar. The reservoir has a top 27 closable by a lid member 28. Outwardly extending flanges 29 may be provided on the foresides of the reservoir for attachment to the wall 18 by means such as screws or the like fastening devices 40. In certain embodiments it may be desirable to interpose a gasket between the flanges and the wall 18.

Where it is desired to control evaporation with a greater degree of specificity than can be accommodated through a choice of the formulation of the odor-deodorant formula one or more air flow control vanes 30 may be provided adjacent the evaporation tray. Such vanes are utilized to increase the air flow across the surface of the evaporation tray and may include for example a conrol knob 31 located externally of the reservoir attached to a control rod 32 carrying the vane. Rotation of the vane will increase or decrease the amount of air flow immediately past the surface of the evaporation tray.

The choice of liquid to be introduced into the unit 15 via the removable lid member 28 to the reservoir 22, is of considerable importance. In order to provide effective control of odors found in normal buildings, such as residences etc., it is desirable that the liquid contain both odorant and odor neutralizing materials. Specifically, I have found that a composition containing from 1 to 4% of a mixture of perfumes and essential oils, from ½ to 2% odor neutralizers and the remainder an evaporatable hydrocarbon is adequate. Specifically, the odor neutralizer will be a material capable of neutralizing odors such as lauryl methacrylate. The hydrocarbon solvent should be one having a specific gravity of between 0.75 and 0.78 and a neutral odor. It is important that the boiling point of the hydrocarbon be sufficiently high so as to not be combustable within the system. Hydrocarbon solvents having boiling points over 350° F are available with the above specifics and are preferably used.

An ideal odor controlled system, according to my invention, would include an odor treatment unit such as the unit 15, installed in a central forced air system downstream of the air temperature treatment area, and preferably, downstream of any humidifiers and/or de humidifiers. The size of the evaporation tray 16 is dependent upon the air flow characteristics of the system. However, I have found that for an average residence having approximately 2200 square feet of living area, an evaporator tray having 18 square inches of surface area was adequate when used in connection with a constant running fan providing an air flow of 1400 cfm past the evaporator tray.

When the reservoir was supplied with an odor controlled material according to the above parameters, it was found that good odor control was achieved throughout the residence and normal household odors were neutralized or masked without the creation of a noticeable counter odor. It is believed that in order to insure that no undesireable counter odor is created that the combination of odor and odor neutralizing material should be kept as a small percentage of the overall fluid to be evaporated such as, for example less than 10%. In addition, it was found that the material evaporated at the rate of 1.125 $in^3$. per 24 hour period. Therefore, at 1400 cfm, the material, having a specific gravity of about 0.77, evaporated at approximately 0.62 fluid ounces per day and supplied approximately $8.65 \times 10^{-10}$ pounds of odor control material per cubic foot of air passing through the plenum per minute at 80° F. Of course, the rate of evaporation is subject to factors such as humidity and temperature, however, it can be seen from the above that my invention allows complete odor control throughout the residence while using a very minuscule amount of odor control material. This slow rate of evaporation is advantageous in that the unit will only have to be serviced every 5 to 7 weeks by the addition of one quart of odor control material to the system.

It can therefore be seen from the above, that my invention provides for residential and commercial building odor control from a central unit installed in a forced air system, the unit including an evaporation tray interior of the system downstream of the air treatment section, the evaporator tray open to the interior of the forced air system and having a reservoir located exterior of the forced air system with a closable opening thereto allowing replenishment of the unit by an odor control material consisting of odorants and odor neutralizers in an evaporatable hydrocarbon solvent.

Although the teachings of my invention have herein been discussed with reference to specific theories and embodiments, it is to be understood that these are by way of illustration only and that others may wish to utilize my invention in different designs or applications.

I claim as my invention:

1. An air odor treatment system for buildings comprising: in combination, a forced air temperature treating system including a central air temperature treating unit discharging to a plenum, the plenum discharging to a plurality of air ducts delivering treated air to various areas within a building structure, an evaporation unit carried by the plenum with an open topped evaporation tray interior of the plenum, a reservoir and filling chamber exterior of the plenum, the reservoir having a closable opening thereto located exterior of the reservoir, the tray and chamber being in liquid flow communication through an opening in a wall of the plenum, the tray and chamber at least partially filled with a liquid consisting essentially of a mixture of odorants, odor neutralizers and a hydrocarbon solvent, the mixture being evaporatable within the plenum and having a boiling point above a maximum temperature within the plenum at a normal operation, at least one air control vane positioned interior of said plenum adjacent the open top of said tray, said air control vane being carried by said evaporation unit, means allowing adjustment of the attitude of said vane with respect to the open top of said tray, said means including a manually actuatable control located exterior of said plenum, and said vane effective to vary the evaporation rate of the liquid within the tray by modifying the air flow within the plenum whereby the amount of liquid evaporated into the air discharging from the plenum is controllable within a range by manually repositioning the attitude of the air control vane.

2. A deodorizing unit for use with a home forced air temperature treating system comprising: a deodorizing fluid, said fluid being volatile at normal treated air temperatures, an evaporator assembly, said assembly being attached to the forced air system and containing amounts of said deodorizing fluid, said deodorizing fluid consisting of a major amount of a hydrocarbon base and a minor amount of a deodorant and an odor neutralizer, the minor amount being less than approximately 10% of the total, the evaporator assembly carried by a plenum of said forced air system, said assembly divided into an exterior and interior sections, said exterior section located of said plenum, said exterior section constituting a filling area having a removable lid, said interior section projecting at a right angle to a major direction of air flow within plenum, said interior section being open on a top surface thereof, said interior and exterior sections being in open communication with one another through a wall of said plenum, said unit including an adjustable air flow deflector positioned within said plenum adjacent said interior section, control member for said deflector exterior of said plenum, means connecting the deflector with the said control member, said deflector pivotably secured to the said unit, the attitude of the deflector variable by actuation of the control member, said deflector positioned with respect to the open top surface to channel air from the major air flow into contact with the surface of the deodorizing material received in said unit, and pivoting of the deflector being effective to modify an amount of air being channeled into contact with the surface of the deodorizing material to modify the amount of deodorizing material being evaporated into the air flow.

* * * * *

UNITED STATES PATENT AND TRADEMARK OFFICE

CERTIFICATE OF CORRECTION

PATENT NO. : 4,030,474

DATED : June 21, 1977

INVENTOR(S) : Ben Brown

It is certified that error appears in the above-identified patent and that said Letters Patent are hereby corrected as shown below:

Column 2, line 33, delete "treatment unit 5 attached thereto" and insert -- treatment unit 15 attached thereto--.

Column 4, line 62, delete "located of said" and insert --located outside of said--.

Signed and Sealed this

*Sixth* Day of *December 1977*

[SEAL]

*Attest:*

RUTH C. MASON
*Attesting Officer*

LUTRELLE F. PARKER
*Acting Commissioner of Patents and Trademarks*